United States Patent [19]

Chaffee et al.

[11] 4,341,858

[45] Jul. 27, 1982

[54] IMAGE-TRANSFER REVERSAL EMULSIONS AND ELEMENTS WITH INCORPORATED QUINONES

[75] Inventors: Eleanor Chaffee, Webster; Richard C. Tuites, Rochester, both of N.Y.

[73] Assignee: Eastman Kodak Company, Rochester, N.Y.

[21] Appl. No.: 259,790

[22] Filed: May 1, 1981

[51] Int. Cl.[3] ..... G03C 7/00; G03C 1/40; G03C 1/10

[52] U.S. Cl. ..... 430/217; 430/223; 430/559; 430/598; 430/562

[58] Field of Search ..... 430/217, 223, 559, 598, 430/562

[56] References Cited

FOREIGN PATENT DOCUMENTS 2461513 10/1975 Fed. Rep. of Germany .

OTHER PUBLICATIONS

Research Disclosure, 16929, 16936, May, 1978, pp. 36 and 10.

*Primary Examiner*—Won H. Louie, Jr.
*Attorney, Agent, or Firm*—James L. Lewis

[57] ABSTRACT

Direct-positive photographic emulsions and elements which include internal-image silver halide grains, a nucleating amount of a hydrazine compound and a redox dye releaser are improved by the incorporation of a nucleation-promoting amount of a quinone oxidizing agent. Diffusion transfer images made from elements using these emulsions exhibit improved image discrimination and improved maximum density.

13 Claims, No Drawings

IMAGE-TRANSFER REVERSAL EMULSIONS AND ELEMENTS WITH INCORPORATED QUINONES

FIELD OF THE INVENTION

The present invention relates to photographic silver halide emulsions and elements. More particularly, the emulsions are of the direct-positive type and include internal-image silver halide grains, a hydrazine nucleator and a redox dye releaser.

DESCRIPTION RELATIVE TO THE PRIOR ART

Photographic elements which produce images having an optical density directly related to the radiation received upon exposure are said to be negative-working. A positive photographic image is formed from two negative-working elements by exposing the second negative-working element to the negative made by exposure of the first. The negative of the first negative is a positive. A direct-positive image, on the other hand, is understood in photography to be a positive image which is formed without first forming a negative image.

A conventional approach to forming a direct-positive image is to use a photographic element having an internal latent image-forming silver halide emulsion. Exposure of this type of silver halide emulsion produces a latent image predominantly on the interior of the silver halide grain. Developing such an exposed silver halide image in a developer which contains a developing agent capable of developing the surface of the silver halide grains but incapable of developing the interior of the grains produces a direct-positive image, provided that the surfaces of the silver halide grains are subjected to fogging conditions during development. In this process, the internal latent image-forming silver halide grains which received imagewise exposure, and therefore have an internal latent image, develop at a comparatively slow rate under these conditions. The internal latent image-forming silver halide grains which have not been imagewise exposed develop comparatively rapidly under these conditions.

The fogging conditions are preferably created through the use of a chemical fogging agent, also referred to in this art as a nucleating agent. The term "nucleating agent" is employed in its art-recognized usage to mean a fogging agent capable of permitting the selective development of internal latent image-forming silver halide grains which have not been imagewise exposed in preference to the development of silver halide grains having an internal latent image formed by imagewise exposure.

In one highly preferred form of color diffusion transfer photography, the direct-positive, internal latent image-forming silver halide emulsions just described are used in combination with negative-working, dye image-providing compounds. Negative-working, dye image-providing compounds are those which produce a negative transfer dye image when used in combination with conventional negative-working silver halide emulsions. When these compounds are used with direct-positive emulsions such as those described above, a positive transfer dye image is formed.

A preferred class of negative-working dye image-providing compounds is referred in the art as redox-dye-releasing (RDR) compounds. In a process using these dye image-providing compounds, a cross-oxidizing developing agent, sometimes referred to as an electron-transfer agent, develops the silver halide and then cross-oxidizes with the dye image-providing compound. This dye image-providing compound usually contains a mobile dye linked through an oxidizable sulfonamido group to a ballasted carrier. Following crossoxidation, hydrolytic deamidation cleaves the mobile dye with the sulfonamido group attached. The mobile dye diffuses to a dye receiver where it is immobilized, usually by a dye mordant.

It is known in the art that, if certain sulfonamido RDR's are incorporated in the direct-positive emulsion layer, the nucleation of the silver halide grains is hampered. The nucleation inhibition may be particularly noticeable if very active sulfonamido RDR compounds are used. To alleviate this problem, it has been suggested that a strong oxidizing agent be incorporated in the layer which contains the direct-positive silver halide emulsion and the sulfonamido RDR. For example, in *Research Disclosure* 16929, May, 1978, a ferricyanide is suggested for use in such a layer. (*Research Disclosure* is published by Industrial Opportunities Ltd, Homewell, Havant, Hampshire, PO9, 1EF, U.K.) It has also been suggested that a strong oxidizing agent be incorporated in the processing solution for a direct-positive silver halide emulsion which is used in conjunction with a color coupler. The strong oxidizing agent, again a ferricyanide, is provided to promote the rate of nucleation. (See, for example, *Research Disclosure* 16936, May, 1978.)

We have found that nucleation is sometimes inhibited even if the RDR is coated in a layer separate from the emulsion, a desirable format discussed more fully below. The inhibition of nucleation appears to be particularly severe in the emulsion layer coated adjacent an oxygen-impermeable support such as a support made from poly(ethylene terephthalate).

From the manufacturing standpoint it is desirable to incorporate the sulfonamido RDR in the direct-positive silver halide emulsion layer; from other points of view, however, it is undesirable. For example, many sulfonamido RDR's are colored and incorporating them in an emulsion layer absorbs light which might otherwise be used to expose the emulsion and therefore causes a decrease in speed of the emulsion. It is desirable, therefore, in many instances to coat the sulfonamido RDR in a layer adjacent the emulsion layer. Unfortunately, in this format we have discovered that the oxidizing agents which are known to promote nucleation in other formats, i.e., the ferricyanides, have no effect on the nucleation. In fact, incorporation of a ferricyanide in the emulsion layer of such a format actually causes a decrease in maximum density and image discrimination in an exposed and processed element. Further, the ferricyanides must be used in fairly large amounts. Ferricyanide compounds in these amounts cause light-absorption problems and produce stain. Also, the ferricyanide compounds mentioned in these *Research Disclosures* are relatively insoluble and must therefore be coated in relatively dilute solutions with relatively large amounts of gelatin. Such high amounts of gelatin produce relatively thick layers which adversely affect the sharpness of the image produced by the element. There is no suggestion in these *Research Disclosure* references as to which oxidizing agents, if any, might be useful in a format wherein the RDR is in a layer separate from the direct-positive silver halide emulsion, and no suggestion as to which oxidizing agents might be used in any format without causing problems in light absorption, stain and solubility.

SUMMARY OF THE INVENTION

It has been discovered that quinone oxidizing agents are useful in direct-positive silver halide emulsions to promote nucleation. The quinones avoid the problems of light-absorption, stain and solubility encountered with prior-art oxidizing agents while still providing for promotion of nucleation. These agents are particularly useful in formats having the emulsion in a layer separate from the layer containing the RDR. These agents are also particularly useful as the emulsions coated adjacent an oxygen-impermeable support such as a polyester support. Further, because of the dispersibility of these oxidizing agents they are compatible with low-gelatin-coating formulations which are coated to produce thin layers.

In addition to promoting nucleation, it has also been discovered that incorporation of the quinone improves other characteristics of diffusion transfer photographic elements. For example, in the donor-receiver peel-apart format described more fully later in this specification, the quinone reduces defects such as streaks, mottle and sensitivity to seasoning and certain types of handling. (Mottle refers to random variations in density over a relatively large area.)

In one aspect of the present invention, there is provided an improved radiation-sensitive silver halide photographic element comprising a support having thereon a layer comprising a redox dye-releasing compound having associated therewith an internal latent image silver halide emulsion and a nucleating amount of a hydrazine compound, the improvement being that the silver halide layer comprises a nucleation-promoting amount of a quinone oxidizing agent. While the RDR is optionally in the same layer as the silver halide, it is preferred that the RDR and silver halide be in separate layers. The promotion of nucleation is particularly apparent in a silver halide layer coated adjacent an oxygen-impermeble support.

In preferred embodiments, the quinone oxidizing agent is an alkylquinone having a standard electrode potential, at pH 7 (in millivolts vs a saturated calomel electrode), no more negative than −50 mv. Also in preferred embodiments, the quinone oxidizing agent is present in the silver halide emulsion in an amount between 0.5 and 25 g/mole of silver in the emulsion.

In another aspect of the present invention, there is provided a diffusion transfer photographic element comprising a support having thereon the layers described above and, associated with those layers either on the same support or on a separate support, an image-receiving layer. Preferably, the image-receiving layer comprises a binder and a mordant for the dye which is released by the RDR.

In another aspect of the present invention, there is provided a method for improving the nucleation of a photographic element comprising a support having thereon a layer comprising a redox dye-releasing compound having associated therewith an internal latent image silver halide emulsion and a nucleating amount of a hydrazine compound, said method comprising the step of providing a quinone oxidizing agent in the silver halide layer.

DETAILED DESCRIPTION OF THE INVENTION

The direct-positive internal latent image silver halide emulsions useful in the present invention include a quinone oxidizing agent. The quinone oxidizing agent preferably has a standard electrode potential (in millivolts vs a saturated calomel electrode) no more negative than −50 mv. Measurement of the standard electrode potential of the quinones which are useful in the present emulsions are made by conventional methods such as those described by James, *Theory of the Photographic Process,* 4th ed, 1977, page 291 et seq. (See in particular pages 292–294, "Experimental Methods".)

Throughout this specification, the quinone will be described as being "in" the emulsion or the emulsion will be described as "containing" the quinone. By these terms, it is meant that the quinone is in the coating composition which forms the silver halide layer.

The quinone oxidizing agents which are used in the emulsions are present in an amount which promotes nucleation. The exact amount varies over a wide range and depends upon the specific silver halide emulsion, the specific hydrazine nucleating agent and the amount thereof, and the oxidizing characteristics of the quinone oxidizing agent. For example, where the standard electrode potential of the quinone oxidizing agent is relatively more negative, a lesser amount of the quinone compound is useful. Similarly, where the standard electrode potential of the quinone is relatively more positive, a greater amount of the quinone is used to promote nucleation. Whether nucleation is promoted by a particular amount of quinone is determined by a simple comparative experiment using two internal image silver halide emulsions, one containing the quinone and another otherwise identical emulsion not containing the quinone. The two emulsions are coated as the emulsions adjacent an oxygen-impermeable support in a three-emulsion multilayer format. The elements are exposed and developed in a like manner and the maximum densities which results from the two comparative emulsions are compared. Nucleation is considered to be promoted if the maximum density of the quinone-containing emulsion is noticeably greater than the maximum density of the emulsion not containing the quinone. Usually, a useful quinone will cause a density increase in this experiment of at least about 0.10.

As mentioned above, the concentration of the quinone oxidizing agent in the direct-positive emulsions varies over a wide range. Usually, the concentration is expressed in terms of the amount of the quinone per mole of the silver in the direct-positive emulsion. The exact amount of quinone will depend, not only on the oxidizing strength of the quinone, but also on the coating format and other factors. Usually, the quinone is present in the amount between 0.5 to 25 g/mole of silver and preferably between 2 and 12 g/mole of silver. It will be readily appreciated that this amount of a quinone is far in excess of the amount of quinone which might be present directly or indirectly for other purposes in conventional direct-positive silver halide emulsions. For example, many direct-positive silver halide elements contain a hydroquinone oxidized developer scavenger. While the hydroquinone scavenger might be in equilibrium with a small amount of the corresponding quinone, this small amount is insufficient to promote nucleation.

Particularly preferred quinone oxidizing agents are those quinones which are substituted in at least one position with either an alkyl group or an aryl group. Useful quinones of these types are represented by the formula:

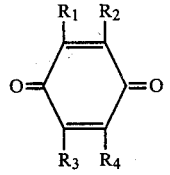

wherein: $R^1$, $R^2$, $R^3$ and $R^4$ are independently selected from the group consisting of a hydrogen atom; an alkyl group having from 1 to 20 carbon atoms including branched- and straight-chain alkyl groups such as methyl, ethyl, hexyl, undecyl, pentadecyl, octadecyl, t-butyl, 1-methyloctyl, 1-methylpentadecyl, 1-ethylpentadecyl and 1-butyldodecyl; an aralkyl group such as benzyl; an aryl group having from 6 to 12 carbon atoms and including substituted aryl groups such as tolyl and methoxyphenyl; an alkoxy group having from 1 to 10 carbon atoms such as methoxy, ethoxy and butoxy; a halogen atom such as fluorine, chlorine or bromine; a cyano group such as cyano or cyanoethyl; an acid group such as carboxy, sulfo, sulfamoyl, carbamoyl, or alkoxycarbamoyl such as ethoxycarbamoyl; and an alkylthio group such as ethylthio and butylthio. Compounds of this structural formula are useful provided that at least one of $R^1$, $R^2$, $R^3$, and $R^4$ is either an alkyl group or an aryl group. Further, the quinone should have a standard electrode potential no more negative than −50 mv at pH 7 vs saturated calomel electrode. Useful quinones within this definition include the following. (Standard electrode potential is listed for each compound.)

(Q1) octadecylquinone (−18 mv)
(Q2) 2,5-diphenylquinone (+7 mv)
(Q3) pentadecylquinone (−17 mv)

The quinone oxidizing agents are incorporated into the direct-positive silver halide emulsions by a variety of methods. For example, the quinone oxidizing agents are mechanically dispersed directly in the emulsion by the technique illustrated in Belgian Pat. No. 852,138. Alternatively, the quinone oxodizing agent is dissolved in a solvent having a high boiling temperature and the resulting solution is dispersed in the directpositive emulsion by the technique illustrated in U.S. Pat. Nos. 2,322,027 and 2,801,171. In yet another embodiment, the quinone compound is loaded into latices and dispersed in the directpositive emulsion by the technique illustrated in *Research Disclosure,* Volume 159, July, 1977, item 15930.

The direct-positive emulsions optionally contain, in addition to the quinone oxidizing agent, a small amount of an oxidized-developer scavenger. The scavenger is preferably a hydroquinone. Particularly useful hydroquinone oxidized-developer scavengers include:

(S1) 2-(2-octadecyl)-5-sulfohydroquinone
(S2) 2,5-bis(1-methylundecyl)hydroquinone Other useful scavengers are described in *Research Disclosure,* Vol 151, item 15162, November, 1976.

The quinone oxidizing agents are incorporated into internal latent image silver halide emulsions. Useful emulsions of this type are directpositive emulsions (not prefogged) which form latent images predominantly inside the silver halide grains. These silver halide grains are distinguished from silver halide grains which form latent images predominantly on the surface of the grains. Useful internal latent image emulsions of this type are described in U.S. Pat. Nos. 2,592,250, 3,761,276, 3,761,266 and 3,761,267. Internal latent image silver halide emulsions are defined in terms of the increased maximum density obtained when developed to a negative silver image with a "internal-type" developer as compared with the image obtained when developed with a "surface-type" developer. An internal-type developer differs from a surface-type developer primarily in that the internal-type developer contains a silver halide solvent such as sodium sulfite.

The quinone oxidizing agents are used with the internal-latent-image-type emulsions described above, which further contain hydrazine nucleating agents. These emulsions provide direct-positive silver images. The term "hydrazine" is intended to include hydrazine and hydrazine derivatives such as hydrazides and hydrazones. Suitable nucleating agents include the hydrazines disclosed in U.S. Pat. Nos. 2,588,982 and 2,563,785; the hydrazides and hydrazones disclosed in U.S. Pat. No. 3,227,552; the hydrazone quaternary salts described in British Pat. No. 1,283,835 and U.S. Pat. No. 3,615,615; hydrazone-containing polymethine dyes described in U.S. Pat. No. 3,718,470; propargyl-substituted hydrazine nucleating agents such as those described in U.S. Pat. No. 4,115,122; thiocarbonohydrazide nucleating agents such as those described in U.S. Pat. No. 4,139,387; and thioureahydrazide nucleating agents described in U.S. Pat. No. 4,030,925. Other useful nucleating agents are described in U.S. Pat. No. 4,080,207 and U.K. Pat. No. 2,011,391. The quantity of nucleating agent varies over a wide range depending upon the results desired. Generally, the concentration of nucleating agent is from about 0.4 to about 8 g/mole of silver in the silver halide emulsion.

Particularly preferred hydrazine nucleating agents are the thioureahydrazide compounds of U.S. Pat. No. 4,030,925 cited above. One particularly useful compound of this type is 1-(4-[2-formylhydrazino]phenyl)-3-methylthiourea (N1).

The direct-positive silver halide emulsions containing the quinone oxidizing agents also comprise a binder or vehicle. The binder is usually a hydrophilic colloid which is used either alone or in combination with other vehicles. Suitable hydrophilic materials include both naturally occurring substances such as proteins, protein derivatives and cellulose derivatives. Useful binders include gelatin, alkali- or acid-treated gelatin, acylated gelatin, phthalated gelatin, polysaccharides such as dextran, and gum arabic. A further discussion of suitable vehicles is found in *Research Disclosure,* Volume 176, December, 1978, item 17643, paragraph IX.

A useful radiation-sensitive silver halide photographic element comprises a support having thereon a layer comprising the described internal latent image silver halide emulsion and, preferably in a separate layer, a redox dye-releasing compound. In preferred embodiments, these dye image-providing materials are ballasted nondiffusible redox dye releasers. These are compounds which are oxidized, i.e., crossoxidized, by an oxidized developing agent to provide a species which, as a function of oxidation, will release a diffusible dye, such as by alkaline hydrolysis. Useful redox dye releasers are described in U.S. Pat. Nos. 3,725,062, 3,698,897, 3,628,952, 3,443,939, 3,443,940, 4,076,529, 3,928,312, 3,728,113, 4,053,312 and 4,055,428; German Pat. Nos. 2,505,248 and 2,729,820; and *Research Disclo-*

*sure* 15157, November, 1976, and *Research Disclosure* 15654, April, 1977.

The term "nondiffusible" means that the material will not substantially diffuse either within or from the layer in which it is located within the photographic element during contact with alkaline solution at a pH, for example, of greater than 11.

Particularly preferred nondiffusible redox dye releasers are described by Fleckenstein et al., U.S. Pat. Nos. 4,076,529 and 3,928,312, referenced above. These compounds are nondiffusible sulfonamido compounds which are alkali-cleavable upon oxidation to release a diffusible sulfonamido dye.

In a further preferred embodiment, of the invention, the RDR is represented by the following formula:

(Ballast-Carrier-Link)-(Col)

wherein:

(a) Col is a dye or dye-precursor moiety;

(b) Ballast is an organic ballasting radical of such molecular size and configuration as to render said compound nondiffusible in said photographic element during development in an alkaline processing composition;

(c) Carrier is an oxidizable acyclic, carbocyclic or heterocyclic moiety (see *The Theory of the Photographic Process,* by C.E. K. Mees and T. H. James, Third Edition, 1966, pages 282–283), e.g., moieties containing atoms according to the following configuration:

$a(-C{=}C)_b-$ wherein:

b is a positive integer of 1 to 2 and a represents the radicals OH, SH, NH— or hydrolyzable precursors thereof; and (d) Link represents a group which, upon oxidation of said carrier moiety, is capable of being hydrolytically cleaved to release the diffusible azo dye. For example, Link may be the following groups:

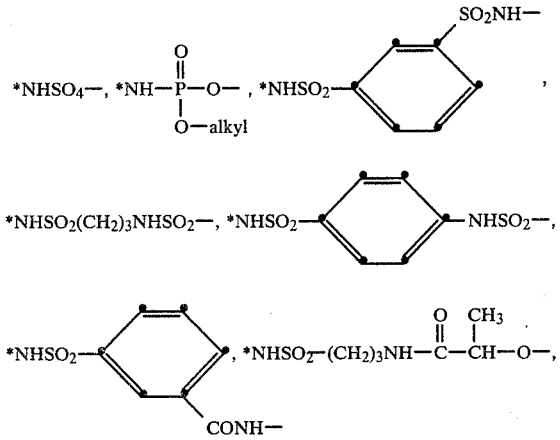

wherein * represents the position of attachment to Carrier.

The ballast group in the above formula is not critical, so long as it confers nondiffusibility to the compound. Typical ballast groups include long-chain alkyl radicals, as well as aromatic radicals of the benzene and naphthalene series linked to the compound. Useful Ballast groups generally have at least 8 carbon atoms such as substituted or unsubstituted alkyl groups of 8–22 carbon atoms, a carbamoyl radical having 8–30 carbon atoms such as $—CONH(CH_2)_4—O—C_6H_3(C_5H_{11})_2$ or $—CO-N—(C_{12}H_{25})_2$, or a keto radical having 8–30 carbon atoms such as $—CO—C_{17}H_{35}$ or $—CO—C_6H_4-(t—C_{12}H_{25})$.

For specific examples of Ballast-Carrier moieties useful as the CAR moiety in this invention, reference is made to the November, 1976, edition of *Research Disclosure,* pages 68–74, and the April, 1977, edition of *Research Disclosure,* pages 32–39.

In a highly preferred embodiment of the invention, the RDR is a compound having the formula:

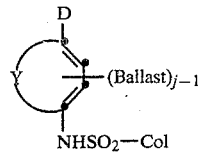

wherein:

(a) Col is a dye or dye-precursor moiety;

(b) Ballast is an organic ballasting radical of such molecular size and configuration (e./g., simple organic groups or polymeric groups) as to render said compound nondiffusible in a photographic element during development in an alkaline processing composition;

(c) D is $OR^4$ or $NHR^5$ wherein $R^4$ is hydrogen or a hydrolyzable moiety such as acetyl, mono-, di- or trichloroacetyl radicals, perfluoroacyl, pyruvyl, alkoxyacyl, nitrobenzoyl, cyanobenzoyl, sulfonyl or sulfinyl; and $R^5$ is hydrogen or a substituted or unsubstituted alkyl group of 1–22 carbon atoms such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, dodecyl, benzyl or phenethyl (when $R^5$ is an alkyl group of greater than 8 carbon atoms, it can serve as a partial or sole Ballast);

(d) Y represents at least the atoms necessary to complete a benzene nucleus, a naphthalene nucleus or a 5- to 7-membered heterocyclic ring such as pyrazolone or pyrimidine; and (e) j is a positive integer of 1 to 2 and is 2 when D is $OR^4$ or when $R^5$ is hydrogen or an alkyl group of less than 8 carbon atoms.

Especially good results are obtained in the above formula when D is OH, J is 2, and Y is a naphthalene nucleus.

Examples of the CAR moiety in this highly preferred embodiment are disclosed in U.S. Pat. Nos. 4,076,529, 3,993,638 and 3,928,312.

In one preferred embodiment, the radiation-sensitive silver halide photographic element is part of a photographic film unit. The photographic film unit comprises:

(a) an integral imaging receiver element comprising a support having thereon the described photosensitive silver halide emulsion layer containing the quinone oxidizing agent and, associated therewith, a layer comprising the redox dye-releasing compound; a dye image-receiving layer; and, having adjacent the integral imaging receiver element, (b) a cover sheet comprising a timing layer, a neutralizing layer and a support; and (c) means for discharging an aqueous alkaline processing composition between the integral imaging receiver element and the cover sheet.

The film unit is used to produce positive images in single- or multi-colors, as well as in black-and-white. In a three-color film unit, each silver halide emulsion layer of the film assembly will have associated therewith a dye image-providing material capable of providing a dye having a predominant spectral absorption within the region of the visible spectrum to which the silver halide emulsion is sensitive. For example, the blue-sensitive silver halide emulsion layer will have yellow dye image-providing material associated therewith.

Integral imaging receiver color diffusion transfer film units are disclosed in Canadian Pat. No. 928,559. In one particularly preferred embodiment, the support for the photosensitive element is transparent and is coated with the image-receiving layer, an opaque light-reflective layer, a black opaque layer and the photosensitive layers having associated therewith the dye image-providing materials. A rupturable container containing an alkaline processing composition and an opacifier such as carbon black is positioned adjacent the top layer and a transparent cover sheet. The cover sheet comprises a transparent support which is coated with a neutralizing layer and the timng layer. The film unit is placed in a camera, exposed through the transparent cover sheet and then passed through a pair of pressure-applying members in the camera as it is being removed therefrom. The pressure-applying members rupture the container and spread the processing composition and opacifier over the image-forming portion of the film unit. The silver halide layers are developed by a developer in the processing composition and dye images are formed as a function of development. The dyes diffuse to the image-receiving layer to provide an image which is viewed through the transparent support on the opaque reflecting layer background. The timing layer breaks down after a period of time and makes available material to neutralize the alkaline processing composition so that further silver halide development does not take place. Further details concerning the format of this particular integral film unit are found in the above-mentioned Canadian Pat. No. 928,559. For details regarding the various components of the layers in this format, reference is made to *Research Disclosure,* Volume 151, November, 1976, item 15162. In an alternative format, the emulsions sensitive to each of the three primary regions of the spectrum are disposed as a single segmented layer, e.g., as by the use of microvessels as described in U.S. Patent Application Ser. No. 184,714 filed Sept. 8, 1980.

In another preferred embodiment, there is provided a photographic film unit of the so-called "peel-apart" type. In this type of film unit, the image-receiving layer is on a receiver element and the process control layers such as the timing and neutralizing layers are on the imaging element, sometimes referred to in this format as the donor element. The receiver element is laminated with the imaging element during processing and then peeled apart from the imaging element after processing is complete. The film unit comprises:

(a) a donor imaging element comprising a support having thereon, in order, a polymeric acid layer, a timing layer, at least one photosensitive silver halide emulsion layer containing the quinone oxidizing agent as described and, associated with the emulsion layer, preferably as a separate layer, a layer comprising the redox dye-releasing compound; and having adjacent the imaging element (b) a receiving element comprising a support having thereon a dye image-receiving layer.

A process for producing a photographic image in a peel-apart element as described above comprises immersing an exposed imaging element in a processing composition, and then bringing the imaging element into face-to-face contact with the dye image-receiving element. The exposed imaging element is immersed in the processing composition for periods of time ranging from about 5 seconds to 30 seconds at temperatures from about 15° C. to 40° C. to effect development of each of the exposed silver halide emulsion layer or layers. The imaging element is then laminated to the dye image-receiving element by passing the two elements together in face-to-face contact through the nip of two rollers. The assemblage is then left laminated together for a period of time ranging from between 1 minute and 15 minutes. An imagewise distribution of dye image-providing material is thus formed as a function of development, and at least a portion of it diffuses to the dye image-receiving layer to provide the transfer image. The receiving element is then peeled apart from the imaging element.

The film unit or assemblage of the present invention is used to produce positive images in single- or multicolors. In a three-color system, each silver halide emulsion layer of the film assembly will have associated therewith a dye image-providing layer which possesses a predominant spectral absorption within the region of the visible spectrum to which said silver halide emulsion is sensitive, i.e., the blue-sensitive silver halide emulsion layer will have a yellow dye image-providing layer associated therewith, the green-sensitive silver halide emulsion layer will have a magenta dye image-providing layer associated therewith and the red-sensitive silver halide emulsion layer will have a cyan dye image-providing layer associated therewith.

The concentration of the dye image-providing material varies over a wide range, depending upon the particular compound employed and the results desired. For example, the dye image-providing material coated in a layer at a concentration of 0.1 to 3 $g/m^2$ has been found to be useful. The dye image-providing material is dispersed in a hydrophilic film-forming natural material or synthetic polymer such as gelatin or polyvinyl alcohol, which is adapted to be permeated by aqueous alkaline processing composition.

The various silver halide emulsion layers of the described color film units are disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer is present between the blue-sensitive and green-sensitive silver halide emulsion layers for absorbing or filtering blue radiation which is transmitted through the blue-sensitive layer. If desired, the selectively sensitized silver halide emulsion layers are disposed in a different order, e.g., the blue-sensitive layer first with respect to the exposure side, followed by the red-sensitive and green-sensitive layers.

A variety of silver halide developing agents are useful. Specific examples of developers or electron-transfer agent (ETA) compounds useful in this invention include hydroquinone compounds, such as hydroquinone, 2,5-dichlorohydroquinone or 2-chlorohydroquinone; aminophenol compounds such as 4-aminophenol, N-methylaminophenol, N,N-dimethylaminophenol, 3-methyl-4-aminophenol or 3,5-dibromoaminophenol; catechol compounds such as catechol, 4-cyclohexylcatechol, 3-methoxycatechol or 4-(N-octadecylamino)-catechol; phenylenediamine compounds such as N,N,N',N'-tetramethyl-p-phenylenediamine. In highly preferred embodiments, the ETA is a 3-pyrazolidinone compound such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, is also useful. While such developing agents are sometimes used in the liquid processing composition, good results are obtained when the ETA is incorporated in a layer or layers of the photographic element or receiving element to be activated by the alkaline processing composition, such as in the silver halide emulsion layers, the dye image-providing material layers, interlayers or the image-receiving layer.

Any material is useful as the dye image-receiving layer, as long as the desired function of mordanting or otherwise fixing the dye images is obtained. The particular material chosen will, of course, depend upon the dye to be mordanted. Suitable materials are disclosed on pages 80–82 of the November, 1976, edition of *Research Disclosure.*

The polymeric acid layer will effect a reduction in the pH of the image layer from about 13 or 14 to at least 11, and preferably 5 to 8 within 3 to 4 minutes after imbibition. Such polymeric acids comprise polymers containing acid groups such as carboxylic acid groups, which are capable of forming salts with alkali metals such as sodium or potassium or with organic bases, particularly quaternary ammonium bases such as tetramethyl ammonium hydroxide. The polymers optionally contain potentially acid-yielding groups such as anhydrides or lactones or other groups which are capable of reacting with bases to capture and retain them. Generally, the most useful polymeric acids contain free carboxyl groups, being insoluble in water in the free acid form and which form water-soluble sodium and/or potassium salts. Examples of suitable polymeric acids include dibasic acid half-ester derivatives of cellulose, which derivatives contain free carboxyl groups, e.g., cellulose acetate hydrogen phthalate, cellulose acetate hydrogen succinate, ethyl cellulose hydrogen succinate, ethyl cellulose acetate hydrogen succinate, carboxymethyl cellulose, polyvinyl hydrogen phthalate, polyvinyl acetate hydrogen phthalate, acetals of polyvinyl alcohol with carboxy-substituted aldehydes, e.g., o-, m- or p-benzaldehyde carboxylic acid; partial esters of ethylene/maleic anhydride copolymers; partial esters of methyl vinyl ether/maleic anhydride copolymers; poly(methyl vinyl ether-co-maleic anhydride); poly(ethylene-co-maleic anhydride); polystyrene-co-maleic anhydride); and poly(dioxene-co-maleic anhydride); hydrolyzed or cyclized poly(vinyl acetate-co-maleic anhydride) or poly(methacryloyloxyethylphosphonic acid).

Particularly good results have been obtained with polymers and copolymers of acrylic acid, such as polyacrylic acid, partial esters or completely hydrolyzed polymers of polymethacrylic acid, poly(acrylic acid-co-ethyl acrylate), poly(acrylic acid-co-methylolacrylamide); poly(acrylic acid-co-butyl acrylate); poly(acrolein-co-acrylic acid); poly(acrylic acid-co-hydroxyethyl acrylate); poly(butyl methacrylate-co-methacrylic acid); or poly(methyl methacrylate-co-methacrylic acid).

One or more timing or inert spacer layers are optionally used over the polymeric acid layer which "times" or controls the pH reduction as a function of the rate at which the alkaline composition diffuses through the timing layer or layers. Such timing layers include hydrolyzable polymers or a mixture of such polymers which are slowly hydrolyzed by the processing composition. Examples of such hydrolyzable polymers include cellulose derivatives such as cellulose acetate phthalate, ethyl cellulose phthalate, a combination of cellulose acetate phthalate and ethyl cellulose phthalate, cellulose acetate hexahydrophthalate, cellulose acetate stearate, cellulose triacetate, cellulose acetate butyrate, and mixtures of cellulose esters; vinyl and acrylate polymers such as poly(phenyl acrylate), poly(cyanomethyl acrylate), poly(methoxymethyl acrylate), poly(ethoxycarbonylmethyl acrylate), poly(methacryloyloxyacetamide), partly hydrolyzed poly(vinyl acetate), poly(methacrylic acid-co-methyl methacrylate) and poly(vinyl acetate-co-maleic anhydride) treated to form an intramolecular esterlactone. Particularly good results have been obtained with a lactone polymer such as a partially hydrolyzed and 1-butanol esterified poly(vinyl acetate-co-maleic anhydride) either alone or mixed with a poly(acrylonitrile-co-vinylidene chloride-co-acrylic acid) terpolymer, as described by Abel, U.S. Pat. No. 4,229,516 issued Oct. 21, 1980, the disclosure of which is hereby incorporated by reference, or a mixture of cellulose acetate with a copolymer of styrene and maleic anhydride.

The alkaline processing or activator composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11. In some embodiments of the invention, the processing composition contains a developing agent. Suitable materials and addenda frequently added to such compositions are disclosed on pages 79–80 of the November, 1976, edition of *Research Disclosure.*

The support for the photographic element and receiving element used in this invention is any material, as long as it does not deleteriously affect the photographic properties and is dimensionally stable. Typical flexible sheet materials are described on page 85 of the November, 1976, edition of *Research Disclosure.* As mentioned previously, quinone-containing emulsions as described are particularly useful adjacent oxygen-impermeable supports such as polyester supports, for example, poly- (ethylene terephthalate) supports. In some instances, the internal latent image emulsion might be in an environment containing sufficient oxidizing capacity to promote nucleation. For example, if the emulsion is coated adjacent a titanium dioxide reflective layer, this reflective layer usually will provide sufficient oxidizing capacity. In these instances, additional oxidizing capacity in the form of the quinone might not be necessary.

The silver halide emulsions useful in this invention are well-known to those skilled in the art and are described in *Research Disclosure,* Volume 176, December, 1978, Item 17643, pages 22–23, "Emulsion preparation and types"; they are usually chemically and spectrally sensitized as described on page 23, "Chemical sensitization" and "Spectral sensitization and desensitization", of the above article; they are optionally protected against the production of fog and stabilized against loss of sensitivity during keeping by employing the materials described on pages 24–25, "Antifoggants and stabilizers", of the above article; they usually contain hardeners and coating aids as described on page 26, "Hardeners", and pages 26–27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25–26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27–28, "Coating and drying procedures", of the above article.

The term "associated with" means that the materials are in the same or different layers so long as the materials are accessible to each other during processing.

The following examples are presented to illustrate the invention.

EXAMPLE 1

A series of radiation-sensitive silver halide photographic elements, the layers of which are described more fully below, was coated on either paper or poly(ethylene terephthalate) support. The elements included red-, green- and blue-sensitive emulsion layers. The red-sensitive layer was coated adjacent the support and had varying amounts of an oxidized-developer scavenger (S) and varying amounts of a quinone oxidizing agent (Q). These variations are summarized below in Table 1. Layer 1 is the red-sensitive emulsion layer. (See coating-composition notes.)

TABLE 1

| Coating | Support | Layer 1 Features | Dmax | Dmin |
|---|---|---|---|---|
| 1 (control) | paper | 12 g/Ag mole of an oxidized developer scavenger, no quinone oxidizing agent | 0.13 | 2.32 |
| 2 (control) | polymer | same as 1 | 0.10 | 1.38 |
| 3 | polymer | 6 g/Ag mole of an oxidized developer scavenger, 6 g/Ag mole of a quinone oxidizing agent | 0.13 | 2.33 |

The above-described photographic imaging donor elements were exposed in a sensitometer through a step tablet. The exposed elements were soaked in an activator solution contained in a shallow tray processor for 15 sec at 28° C. The soaked elements were then immediately laminated between nip rollers to a dry dye mordant receiver element. After 2½ min at room temperature, 22° C., the donor and receiver elements were pulled apart. The red densities of the various steps in the step image were read on a densitometer and a sensitometric curve of the image was obtained. Table 1 compiles the results of these experiments. In the column labeled "Dmax" are listed the red densities which were produced from the step which gave the least exposure. Correspondingly, the values for "Dmin" are the red density values for the step which gave the maximum exposure.

The results show that the incorporation of octadecyl quinone in the red-sensitive emulsion layer gives essentially equivalent sensitometry to that obtained by coating the red-sensitive emulsion layer on an oxygen-permeable support such as paper. Further experiments showed that at least 1.5 g/Ag mole of Q1 were required in this format to obtain good cyan sensitometry.

COATING COMPOSITION NOTES

Each of the photosensitive elements for Example 1 contained nine layers, as follows. (Coverages are provided in parentheses, indicating g/m$^2$, or brackets, indicating g/Ag mole. The individual compounds, e.g. N1, S2, etc., are identified earlier in this specification.)

| Layer | |
|---|---|
| 9 overcoat | |
| 8 blue-sensitive silver halide | silver (0.38); scavenger S1 [12]; nucleator N1 [.020]; gel (1.35) |
| 7 yellow dye-releaser | yellow RDR (0.59); gel (1.08) |
| 6 interlayer | scavenger S2 (0.43); gel (0.97) |
| 5 green-sensitive silver halide | silver (0.43); scavenger S2 [12]; nucleator N1 [.020]; gel (1.35) |
| 4 magenta dye-releaser | magenta RDR (0.48) dispersed in diethyllauramide (0.24); gel (1.08) |
| 3 interlayer | scavenger S2 (0.43); gel (0.97) |
| 2 cyan dye-releaser | cyan RDR (0.38); gel (1.08) |
| 1 red-sensitive silver halide | silver (0.32); scavenger S1 [see Table 1]; octadecylquinone Q1 [see Table 1] dispersed in 2,4-di-t-amylphenol (0.04); nucleator N1 [.020]; gel (1.35) |

The emulsions used in Layers 1, 5 and 8 were approximately 0.75μmonodispersed, octahedral, internal-image-type silver bromide emulsions as described by Evans, U.S. Pat. No. 3,923,513. All emulsions contained 100 mg/Ag mole of an antifoggant. The hardener was 1.25% bis(vinylsulfonyl)methyl ether based on total gel weight. The redox dye releasers (RDR's) were of the following structure (similar to those described in *Re-*

*search Disclosure,* 18268, Vol 182, July, 1979, pp 329–331):

I. Yellow RDR

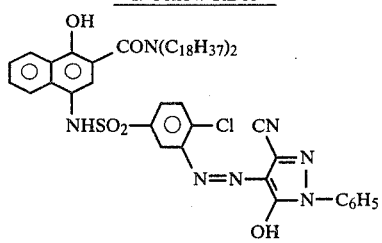

III. Magenta RDR

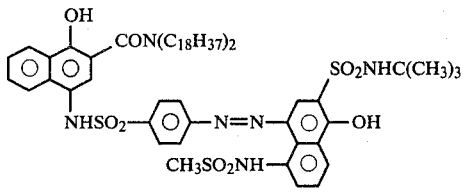

IV. Cyan RDR

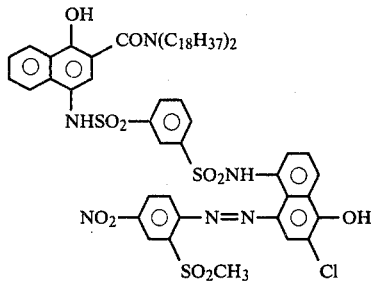

The activator solution consists of the following:
potassium hydroxide, 0.5 normal
5-methylbenzotriazole, 1.0 g/l
11-aminoundecanic acid, 2.0 g/l
potassium bromide, 4.0 g/l
benzyl alcohol, 8.0 ml/l The dye mordant receiver consisted of a polyethylene-coated paper support having thereon a layer containing:

poly(1-vinylimidazole) quaternized to 10% as the 2-hydroxyethyl chloride salt, 3.4 g/m$^2$-mordant
4-hydroxymethyl-4-methyl-1-phenyl-3-pyrazolidinone, 0.16 g/m$^2$-ETA
gelatin, 1.7 g/m$^2$

EXAMPLE 2

This is a comparative example.

This example illustrates the use of cadmium ferricyanide as the oxidizing agent in a photographic element having the redox dye-releasing compound in the internal latent image silver halide grains in separate layers.

Cadmium ferricyanide was prepared from cadmium chloride and potassium ferricyanide according to the procedure in *Research Disclosure,* Volume 169, May, 1978, item 16929. The precipitated material was dispersed in gelatin and used to prepare an image-transfer donor on poly(ethylene terephthalate) support of the following structure:

| Layer | |
|---|---|
| (1) overcoat | |
| (2) emulsion | green-sensitized internal latent image silver bromide (1.1 Ag); scavenger S1 [12]; nucleator N1 [0.040]; CdII [0.5] as $Cd_3[Fe(CN)_6]_2$; gelatin (1.6) |
| (3) dye-releaser | (0.54) magenta RDR dispersed in diethyllauramide |

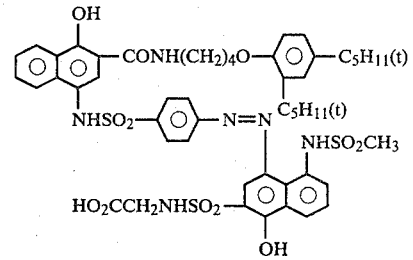

This donor was exposed and processed in a manner similar to that described in Example 1. The donor was soaked in the activator at 25° C. for 40 sec; the lamination time with the receiver was 2½ min. The activator was similar to that in Example 1 except that potassium phosphate was used as the base, which resulted in a pH of 11.5.

The results of these examples are as follows:

| | Dmax | Dmin |
|---|---|---|
| control (no Cd II in layer 2) | 2.5 | 0.29 |
| comparative experiment | 0.64 | 0.29 |

The low Dmax of the coating containing the cadmium ferricyanide did not produce a useable image.

It is noted that the control in this experiment, i.e., the element which contained no cadmium ferricyanide, had a Dmax which was considerably higher than the control of Example 1. However, the data for these two Examples are not directly comparable because the elements in Example 1 contain multiple radiation-sensitive and redox dye-releaser layers while the elements in this example contain but one set. This example is presented merely to illustrate that the cadmium ferricyanide is not a useful oxidizing agent in this format and actually restrains useful imaging.

EXPERIMENT 3

A series of single-color photosensitive imaging donor elements of the type described in Example 2 was prepared. Each element, described in more detail below, comprised a poly(ethylene terephthalate) support having coated thereon a magenta dye-releaser layer, a green-sensitive, internal latent image silver halide layer, a gelatin layer designed to simulate the diffusion path of a multicolor element, and an overcoat layer. Variations were made in the quinone oxidizing agent in the green-sensitive silver halide layer. The control contained no quinone oxidizing agent in this layer. The results of this experiment are presented in Table 3 which follows.

TABLE 3

| Example | Quinone in Layer | Dmax | Dmin |
|---|---|---|---|
| control | none | 0.28 | 0.16 |
| 3a | Q(1) [6.8] | 0.42 | 0.15 |
| 3b | Q(3) [6.0] | 0.66 | 0.16 |
| 3c | Q(3) [12.0] | 0.40 | 0.14 |

TABLE 3-continued

| Example | Quinone in Layer | Dmax | Dmin |
|---|---|---|---|
| 3d | Q(2) [4.9] | 2.0 | 0.14 |

All of the tested quinones gave a benefit in image discrimination compared with the control. In this particular single-color format, the greatest improvement was with 2,5-diphenylquinone (Q2).

| Coating Notes | |
|---|---|
| Layer | |
| (1) overcoat | |
| (2) gelatin (7.0) | |
| (3) green-sensitive silver halide layer | silver (0.43); nucleator N1 [0.20]; quinone oxidizing agent [see table]; gelatin (1.4) |
| (4) magenta dye-releaser | magenta RDR (see Example 1) (0.48); gelatin (0.97) |

The activator solution and dye mordant receiver were the same as in Example 1 except that the activator solution was deaerated.

EXAMPLE 4

A 150-cm$^2$ area of two multicolor photosensitive donors similar to that in Example 1, except that a timing layer and an acid layer were coated between the red-sensitive layer and the support, were uniformly flashed in a sensitometer to yield a neutral density of approximately 1.0. They were then soaked in an activator solution contained in a shallow-tray processor for 15 sec at 28° C. and then laminated between nip-rollers to a dry dye-mordant receiver. After 10 min at room temperature, 22° C., the donors and receivers were pulled apart. The uniformity of the flashed neutral density image was evaluated visually.

| Features of the Green-Sensitive Layer | Judgment of Image Quality |
|---|---|
| 12 g/Ag mole scavenger S1, no quinone (control) | Poor uniformity. Marked high-density magenta streaks and mottle. |
| No scavenger, 6 g/Ag mole Q1 dispersed in 2,4-di-t-amylphenol (0.4 g/m$^2$) | Marked improvement in uniformity of neutral image, barely visible magenta streaks. Mottle improved. |

The invention has been described in detail with particular reference to certain preferred embodiments thereof, but it will be understood that variations and modifications can be effected within the spirit and scope of the invention.

We claim:

1. In a radiation-sensitive silver halide photographic element comprising a support having thereon a layer comprising a redox dye-releasing compound and having associated therewith an internal latent image silver halide emulsion and a nucleating amount of a hydrazine compound, the improvement wherein said silver halide layer comprises a nucleation-promoting amount of a quinone oxidizing agent.

2. In a radiation-sensitive diffusion transfer silver halide photographic film unit:

(a) a layer comprising a redox dye-releasing compound, (b) a dye image-receiving layer and (c) a layer comprising a binder, internal latent image silver halide emulsion and a nucleating amount of a hydrazine compound, the improvement wherein said silver halide layer comprises a nucleation-promoting amount of a quinone oxidizing agent.

3. In a radiation-sensitive diffusion transfer silver halide photographic film unit comprising:

(1) an integral imaging-receiver element comprising a support having thereon:

(a) a first layer comprising a redox dye-releasing compound, (b) a second layer comprising a binder, internal latent image silver halide grains and a nucleating amount of a hydrazine compound, and (c) a dye image-receiving layer containing a dye mordant and, having adjacent said integral imaging-receiver element, (2) a cover sheet comprising, in order, starting with the layer adjacent said integral imaging-receiver element, a timing layer, a neutralizing layer for neutralizing in alkaline processing composition and a support; and (3) an aqueous alkaline processing composition and means for discharging same between said integral imaging-receiver element and said cover sheet;

the improvement wherein said second layer comprises a nucleation-promoting amount of a quinone oxidizing agent.

4. In a radiation-sensitive diffusion transfer silver halide photographic film unit comprising:

(1) a donor imaging element comprising a support having thereon, in order:

(a) a polymeric acid layer, (b) a timing layer, (c) a radiation-sensitive silver halide layer comprising a binder, internal latent image silver halide grains and a nucleating amount of a hydrazine compound and (d) a layer comprising a sulfonamido redox dye-releasing compound, and (2) a receiving element comprising, in order, starting with the layer adjacent said imaging element, a dye image-receiving layer and a support;

the improvement wherein said radiation-sensitive layer comprises a nucleation-promoting amount of a quinone oxidizing agent.

5. The element of claims 1 or 2 wherein said redox dye-releasing compound and said silver halide emulsion are in separate layers.

6. The element of claims 1, 2, 3 or 4 wherein said support is oxygen-impermeable.

7. The element of claims 1, 2, 3 or 4 wherein said quinone oxidizing agent has a standard electrode potential which is no more negative than −50 mv at pH 7 when compared with a saturated calomel electrode.

8. The element according to claims 1, 2, 3 or 4 wherein said quinone oxidizing agent is present in an amount from 0.5 g/mole of silver halide to about 25 g/mole of silver halide.

9. The element according to claims 1, 2, 3 or 4 wherein said quinone compound is represented by the formula:

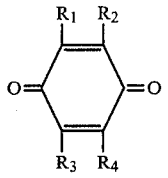

wherein $R^1$, $R^2$, $R^3$ and $R^4$ are independently selected from the group consisting of a hydrogen atom, an alkyl group, an aralkyl group, an aryl group, an alkoxy group, a halogen atom, a cyano group, an acid group and an alkylthio group; with the proviso that at least one of $R^1$, $R^2$, $R^3$ and $R^4$ is an alkyl group or an aryl group.

10. The element according to claims 1, 2, 3 or 4 wherein said quinone is selected from the group consisting of octadecylquinone, 2,5-diphenylquinone and pentadecylquinone.

11. The element according to claims 1, 2 or 3 wherein said redox dye-releasing compound is a sulfonamido compound.

12. The element according to claims 1, 2, 3 or 4 wherein said hydrazine compound is 1-[4-(2-formylhydrazino)phenyl]-3-methylthiourea.

13. A method for improving the nucleation in a radiation-sensitive silver halide photographic element comprising a support having thereon:

(a) a first layer comprising a redox dye-releasing compound and (b) a second layer comprising a binder, internal latent image silver halide grains and a nucleating amount of a hydrazine compound, said method comprising the step of providing a nucleation-promoting amount of a quinone oxidizing agent in said second layer.

* * * * *